United States Patent [19]

Kawanishi et al.

[11] Patent Number: 4,966,282

[45] Date of Patent: Oct. 30, 1990

[54] ELECTRONIC COMPONENT CARRIER

[75] Inventors: Michirou Kawanishi; Kaoru Aizawa; Tatsuo Kurono, all of Osaka, Japan

[73] Assignee: Nitto Denko Corporation, Osaka, Japan

[21] Appl. No.: 393,173

[22] Filed: Aug. 14, 1989

[30] Foreign Application Priority Data

Jan. 13, 1989 [JP] Japan ..... 1-2920[U]

[51] Int. Cl.[5] ..... B65D 73/02

[52] U.S. Cl. ..... 206/330; 206/460

[58] Field of Search ..... 206/460, 328, 330

[56] References Cited

U.S. PATENT DOCUMENTS

| | | | |
|---|---|---|---|
| 4,406,367 | 9/1983 | Bouwknegt | 206/460 |
| 4,411,362 | 10/1983 | Itemadani et al. | 206/460 |
| 4,562,924 | 1/1986 | Okamoto | 206/460 |
| 4,657,137 | 4/1987 | Johnson | 206/460 |

FOREIGN PATENT DOCUMENTS

| | | | |
|---|---|---|---|
| 70370 | 9/1987 | Japan | 206/460 |

*Primary Examiner*—Joseph Man-Fu Moy
*Attorney, Agent, or Firm*—Sughrue, Mion, Zinn, MacPeak & Seas

[57] ABSTRACT

An electronic component carrier includes a carrier tape having a series of through holes formed therethrough and spaced from one another at a predetermined interval along the length of the casrrier tape. An adhesive tape having an adhesive layer is bonded to one side of the carrier tape by the adhesive layer. The adhesive layer partially covers each of the through holes. A plurality of electronic components are received respectively in the series of through holes and are bonded to that portion of the adhesive layer partially covering the through holes, thereby holding the electronic components on the carrier tape. An area of adhesive contact between the adhesive tape and the carrier tape and an area of adhesive contact between the adhesive tape and the electronic component can be isolated from each other at least in the direction of the width of the carrier tape.

9 Claims, 2 Drawing Sheets

ELECTRONIC COMPONENT CARRIER

BACKGROUND OF THE INVENTION

1. Field of the Invention

This invention relates to an electronic component carrier for immovably holding chip-like electronic components in a regular manner so as to carry them.

2. Prior Art

Such a conventional electronic component carrier is used mainly for accurately transferring and feeding chip-like electronic components to an applicator for applying them to circuit boards. Recently, in order to meet with the rationalization of the production line, it has been considered important to transfer the electronic components in a large amount with a tape reel system.

FIGS. 7 and 8 show one example of carriers of such a tape reel system. More specifically, the carrier comprises a carrier tape 1' which has a series of discrete through holes 11' formed through the carrier tape 1' and spaced from one another at a predetermined interval along the length of the carrier tape 1', and a series of discrete feed perforations 12' formed through the carrier tape 1' and spaced from one another at a predetermined interval along the length of the carrier tape 1', the through holes 11' and the perforations 12' being positioned in predetermined relation to each other. Chip-like electronic components 3' are received in the through holes 11', respectively, and are bonded to an adhesive layer 21' of an adhesive tape 2' bonded to one side of the tape 1'. Reference numeral 20' denotes a substrate of the adhesive tape 2'.

The carrier of such a construction is wound into a roll when it is stored and when it is applied or fed. Since the adhesive tape 2' is thin, the adhesive tape 2' is subjected to deflection due to a difference in circumferential length between the carrier tape 1' and the adhesive tape 2'. Such deflection concentrates on those portions of the adhesive tape 2' which are not bonded to the carrier tape 1' (that is, at the regions where the through holes 11' are provided). When such stress develops, the interface between the adhesive layer 21' and the electronic component 3' is curved, so that the electronic component 3' is liable to be released from the adhesive tape 2' as the deformation of the substrate 20' occurs, because the adhesive layer 21' is provided over the entire surface of the substrate 20'. As a result, the electronic component 3' in the through hole 11' is often released from the adhesive tape 2' or displaced with respect to the adhesive tape 2'. Therefore, when applying the electronic components 3', they could not be picked up at high speed in a stable manner.

SUMMARY OF THE INVENTION

It is therefore an object of this invention to provide an electronic component carrier which can hold the electronic components in position.

According to one aspect of the present invention, there is provided an electronic component carrier comprising:

(a) a carrier tape having a series of through holes formed therethrough and spaced from one another at a predetermined interval along the length of the carrier tape; and (b) an adhesive tape having an adhesive layer by which the adhesive tape is bonded to one side of the carrier tape, the adhesive layer partially covering each of the through holes;

(c) a plurality of electronic components being adapted to be received respectively in the series of through holes and to be bonded to that portion of the adhesive layer partially covering the through holes, thereby holding the electronic components on the carrier tape.

According to another aspect of the present invention, there is provided an electronic component carrier comprising:

(a) a carrier tape having a series of through holes formed therethrough and spaced from one another at a predetermined interval along the length of the carrier tape; and (b) an adhesive tape having an adhesive layer by which the adhesive tape is bonded to one side of the carrier tape;

(c) a plurality of electronic components being adapted to be received respectively in the series of through holes and to be bonded to the adhesive layer, thereby holding the electronic components on the carrier tape, and an area of adhesive contact between the adhesive tape and the carrier tape and an area of adhesive contact between the adhesive tape and the electronic component being isolated from each other at least in the direction of the width of the carrier tape.

DESCRIPTION OF THE PREFERRED EMBODIMENTS OF THE INVENTION

The invention will now be described with reference to the drawings.

Figure 1:
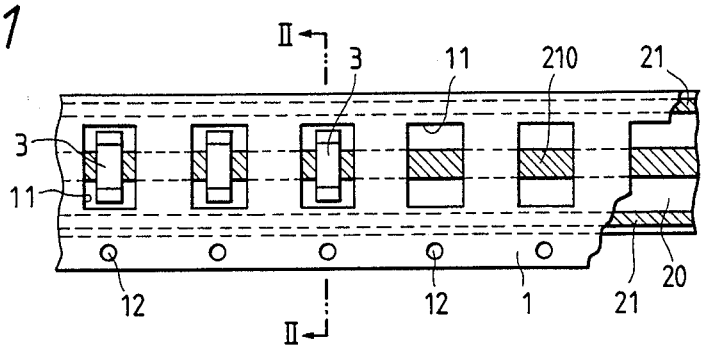
FIG. 1 is a fragmentary plan view of an electronic component carrier provided in accordance with the present invention.
Figure 2:
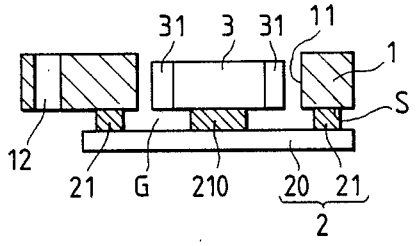
FIG. 2 is a cross-sectional view taken along the line II—II of FIG. 1.

An electronic component carrier of the present invention shown in FIGS. 1 and 2 comprises a carrier tape 1 which has a series of discrete through holes 11 formed through the carrier tape 1 and spaced from one another at a predetermined interval along the length of the carrier tape 1, and a series of discrete feed perforations 12 formed through the carrier tape 1 and spaced from one another at a predetermined interval along the length of the carrier tape 1, the through holes 11 and the perforations 12 being positioned in predetermined relation to each other. The perforations 12 are provided at one lateral edge portion, and the through holes 11 are provided between the other lateral edge and the perforations 12. Chip-like electronic components 3 are received in the through holes 11, respectively, and held in position by an adhesive tape 2.

The adhesive tape 2 is adhesively bonded to one side of the carrier tape 1, and has a substrate 20 and three adhesive layers 21, 210 and 21 formed on one side of the substrate 20 and extending along the length of the substrate 20 in parallel spaced relation to one another. The adhesive tape 2 has such a width that it covers the through holes 11 but does not cover the feed perforations 12. The intermediate adhesive layer 210 is bonded to the widthwise central portion of each electronic component 3 received in a respective one of the through holes 11, and the other two adhesive layers 21 and 21 are bonded respectively to the opposite lateral edge portions of the carrier tape 1. The electronic components 3 are bonded to the surface of the adhesive layer 210 and fixed thereto. In FIG. 2, reference numerals 31 and 31 denote electrode portions of the electronic component 3. Thus, the adhesive layer 210 is provided to partially cover each of the through holes 11, and the three adhesive layers 21, 210 and 21 are provided independently of one another.

In this embodiment, the carrier tape 1 is made of a cardboard or a sheet of a plastics material, and has a thickness generally equal to the thickness of the electronic component 3, and each electronic component 3 is received within the through hole 11. The thickness of the carrier tape 1 may be reduced so that the electronic component 3 projects outwardly from the through hole 11, in which case the electronic component 3 can be bonded to the adhesive tape 2 after deforming the adhesive tape 2 at the through hole 11 in an amount corresponding to the thickness of the carrier tape 1.

Figure 3:
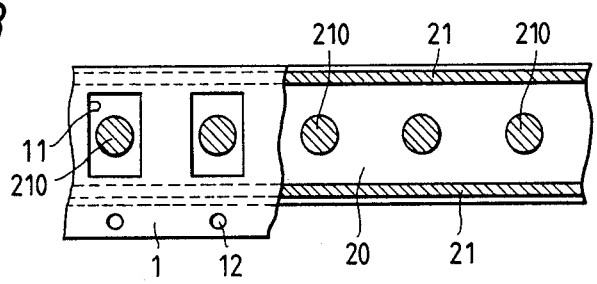
FIG. 3 is a fragmentary plan view of a modified electronic component carrier.

The substrate 20 of the adhesive tape 2 is made, for example, of a thin paper sheet, a plastics film or a metal foil, and usually has a thickness of about 0.01 to about 0.3 mm. A pressure-sensitive adhesive can be s used to provide the adhesive layers 21, 210 and 21, examples of such pressure-sensitive adhesive include an adhesive of the rubber type such as natural and/or synthetic rubbers, an acryl-type adhesive, and a silicone-type adhesive. Usually, the width of the adhesive layers is about 0.1 mm to 5.0 mm, and the thickness is about 5 $\mu$m to 200 $\mu$m. The adhesive layer 210 need only be provided to partially cover each through hole 11 when the adhesive tape 2 is bonded to the carrier tape 1. For example, as shown in FIG. 3, the intermediate adhesive layer 210 may be provided in the form of spots on the substrate 20.

Figure 4:
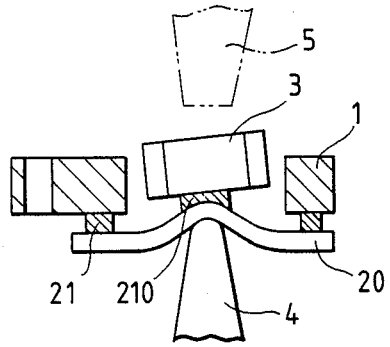
FIG. 4 is a view similar to FIG. 2, but showing the removal of an electronic component from a carrier tape using a push member.

The electronic component carrier of the above construction is mechanically fed through the feed perforations 12, and the electronic components 3 are sequentially picked up by a suction nozzle or other suitable device and are applied to a circuit board. When the electronic component 3 is to be removed from the carrier, the electronic component 3 can be pushed by an electronic component-push member 4 from the reverse side of the carrier tape 1 so as to facilitate the pickup of the electronic component 3, as shown FIG. 4. Since the adhesive layer is absent (that is, not provided) at the marginal portions of the electronic component 3 as shown in the drawings, the electronic component 3 can be picked up even if the component 3 is inclined when pushed by the push member 4. If the electronic component 4 is bonded its entire marginal portion to the adhesive layer, this not be done.

Figure 5:
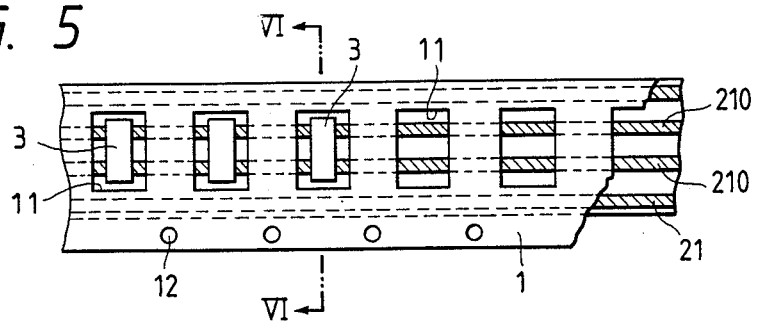
FIG. 5 is a fragmentary plan view of another modified electronic component carrier.
Figure 6:
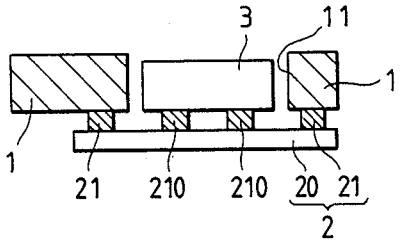
FIG. 6 is a cross-sectional view taken along the line VI—VI of FIG. 5.
Figure 7:
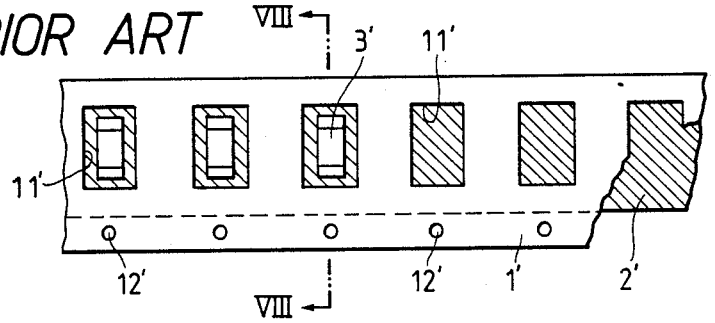
FIG. 7 PRIOR ART
FIG. 7 is a fragmentary plan view of an electronic component carrier provided in accordance with the prior art.
Figure 8:
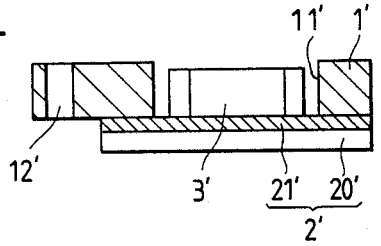
FIG. 8 PRIOR ART
FIG. 8 is a cross-sectional view taken along the line VIII—VIII of FIG. 7.

According to a modified form of the shown in FIGS. 5 and 6, the adhesive layer is absent at that portion of the substrate 20 against which the tip end of the push member 4 is adapted to be pressed. With this arrangement, the inclination of the electronic component 3 is reduced, thereby enabling a more stable pickup of the electronic component 3.

As shown in FIGS. 1 to 6, the areas of adhesive contact between the adhesive tape 2 and the carrier tape 1 and the area of adhesive contact between the adhesive tape 2 and the electronic component 3 are isolated or spaced from one another (that is, independently of one another) at least in the widthwise direction of the carrier tape 1. With this construction, even if the carrier tape 1 is peeled or released from the adhesive layer 21 at the interface S therebetween, the releasing stress developing at the interface S would not be applied to the interface between the electronic component 3 and its mating adhesive layer 210. Therefore, such peeling or releasing of the electronic component from its mating adhesive layer hardly occurs.

With the above construction of the present invention, the following advantages are achieved:

(1) The adhesive layer of the adhesive tape partially covers each of the through holes, and therefore even when deflection concentrates on that portion of the adhesive tape partially covering the through hole, the stress acting on the adhesive layer is relieved by a gap G (FIG. 2) between the adjacent adhesive layers, thereby preventing the interface between the adhesive tape and the electronic component from being curved. Therefore, the releasing of the electronic component from the carrier, as well as the displacement of the electronic component relative to the carrier tape, due to such deflection stress can be prevented.

(2) The area of adhesive contact between the adhesive tape and the carrier tape and the area of adhesive contact between the adhesive tape and the electronic component are isolated from each other at least in the direction of the width of the carrier tape. With this arrangement, even when the adhesive tape is released from the carrier tape at one or both of the lateral edge portions of the carrier tape the releasing and displacement of the electronic component can be prevented.

(3) Since that portion of the adhesive layer partially covering each through hole is absent at marginal portions of the electronic component, the electronic component can be positively picked up even when the electronic component is inclined upon pushing of the push member.

(4) With respect to the construction shown FIGS. 5 and 6, the adhesive layer is absent at that portion of the adhesive tape against which the tip end of the push member is adapted to be pressed. With this arrangement, the electronic component is prevented from being inclined when it is by the push member, thereby enabling a stable removal of the electronic component from the carrier.

What is claimed is:

1. An electronic component carrier comprising:

(a) a carrier tape having a series of through holes formed therethrough and spaced from one another at a predetermined interval along the length of said carrier tape; and (b) an adhesive tape having an adhesive layer by which said adhesive tape is bonded to one side of said carrier tape, said adhesive layer being partially provided with respect to the substrate of said adhesive tape in such a manner that said adhesive layer partially covers each of said through holes;

(c) a plurality of electronic components being adapted to be received respectively in said series of through holes and to be bonded to that portion of said adhesive layer partially covering said through holes, thereby holding said electronic components on said carrier tape.

2. An electronic component carrier comprising:

(a) a carrier tape having a series of through holes formed therethrough and spaced from one another at a predetermined interval along the length of said carrier tape; and (b) an adhesive tape having an adhesive layer by which said adhesive tape is bonded to one side of said carrier tape;

(c) a plurality of electronic components being adapted to be received respectively in said series of through holes and to be bonded to said adhesive layer, thereby holding said electronic components on said carrier tape, an area of adhesive contact between said adhesive tape said carrier tape and an area of adhesive contact between adhesive tape and said electronic component being isolated each other at least in the direction of the width of said tape.

3. An electronic component carrier according to claim 1, in which said adhesive layer covers each of said through holes in such a manner that said adhesive layer is absent at marginal portions of said electronic component.

4. An electronic component carrier according to claim 2, in which said adhesive layer covers each of said through holes in such a manner that said adhesive layer is absent at marginal portions of said electronic component.

5. An electronic component carrier according to claim 1, for use in combination with a push member for pushing said electronic component away from said carrier tape, in which said adhesive layer is absent at that portion of said adhesive tape against which a tip end of said push member is adapted to be pressed.

6. An electronic component carrier according to claim 2, for use in combination with a push member for pushing said electronic component away from said carrier tape, in which said adhesive layer is absent at that portion of said adhesive tape against which a tip end of said push member is adapted to be pressed.

7. An electronic component carrier according to claim 3, for use in combination with a push member for pushing said electronic component away from said carrier tape, in which said adhesive layer is absent at that portion of said adhesive tape against which a tip end of said push member is adapted to be pressed.

8. An electronic component carrier according to claim 4, for use in combination with a push member for pushing said electronic component away from said carrier tape, in which said adhesive layer is absent at that portion of said adhesive tape against which a tip end of said push member is adapted to be pressed.

9. An electronic component carrier comprising:

(a) a carrier tape having a series of through holes formed therethrough and spaced from one another at a predetermined interval along the length of said carrier tape;

(b) an adhesive tape having an adhesive layer by which said adhesive tape is bonded to one side of said carrier tape, said adhesive layer being partially provided with respect to the substrate of said adhesive tape in such a manner that a first portion of said adhesive layer partially covers each of said through holes and at least a second portion is bonded to an edge portion of said carrier tape; and (c) a plurality of electronic components being adapted to be received respectively in said series of through holes and to be bonded to said first portion of said adhesive layer partially covering said through holes, thereby holding said electronic components on said carrier tape.

* * * * *